US005946730A

United States Patent [19]

Blair

[11] Patent Number: 5,946,730

[45] Date of Patent: Sep. 7, 1999

[54] MATERNITY INSERT PANEL FOR JEANS

[76] Inventor: Vivia M. Blair, 6038 May St., Boise, Id. 83703

[21] Appl. No.: 08/984,703

[22] Filed: Dec. 3, 1997

[51] Int. Cl.[6] ..... A41F 9/02

[52] U.S. Cl. ..... 2/227; 2/237; 2/236; 2/220; 2/221

[58] Field of Search ..... 2/69, 69.5, 78.1, 2/78.2, 78.3, 78.4, 79, 76, 227, 236, 237, 408, 219

[56] References Cited

U.S. PATENT DOCUMENTS

| | | | |
|---|---|---|---|
| 1,861,383 | 5/1932 | Ficcio | 2/227 |
| 4,580,298 | 4/1986 | Tuisl | 2/237 |
| 4,683,595 | 8/1987 | Cash | 2/105 |
| 4,961,234 | 10/1990 | Leibman | 2/408 |
| 5,163,184 | 11/1992 | Reardon | 2/237 |

OTHER PUBLICATIONS

Lynn Sutherland, "Pregnant and Chic", Workman Publishing, New York, 1989, pp. 35 and 37.

*Primary Examiner*—Gloria Hale

*Attorney, Agent, or Firm*—Ken J. Pedersen; Barbara S. Pedersen

[57] ABSTRACT

Various embodiments of a maternity insert panel for jeans or other button-fly garments are shown and described. The insert is a V-shaped cloth constructed preferably of a firmly-woven stretch fabric and may be faced with generally the same color fabric as the garment. The insert may be designed with a plurality of buttonholes along one side of the V and matching buttons along the opposite side of the V. The panel is buttoned into the fly of a pair of jeans, with the wide part of the V at the waist. Due to its V-shape and firmness, this panel offers support and comfort, because the waist is expanded the same amount to each side of the wearer and the thin, smooth panel applies gentle, even pressure against the wearer. When a pregnancy is over and a normal clothing size is needed, the V-shaped panel can simply be un-buttoned and removed out of the jeans.

2 Claims, 4 Drawing Sheets

MATERNITY INSERT PANEL FOR JEANS

BACKGROUND OF THE INVENTION

1. Field of the Invention

This invention relates to a method of expanding and retracting the waist size of women's jeans, which is particularly needed during pregnancy. More specifically, the invention is a generally V-shaped insert for button-fly jeans or pants which expands the waist size of such front-buttoning garments. The insert allows the jeans or pants to be re-buttoned back to normal size when the pregnancy is over.

2. Related Art

Inevitably, a pregnant woman needs to acquire a new wardrobe, not only to accommodate the various stages of size expansion during pregnancy, but also to address the fact that some time passes, after giving birth, before one's normal size is re-attained. Over the years, various types of smocks, tops, and bottoms have been devised. In general, the various tops are designed to cover the entire abdominal area, including the top region of the bottom garment, that is of pants, slacks, or skirts. In general, many styles of tops, as long as they are wide and long, can be comfortable and attractive for the wearer. Designing the bottom garment to accommodate and support the expanded abdominal area has been much more vexing to the designer and of greater concern for appearance and comfort to the wearer.

For many years, slacks and skirts simply had the frontal area cut out, and this was expected to be concealed by a lengthy top. The slacks or skirt were usually just tied around or above the protruding area in order to stay up. Of course, this provided no support whatsoever, so when the stretch maternity panel (sewed in where the open space was) came on the market, it was hailed as a great improvement. This still really had the same disadvantages, the only difference being a slight amount of tummy support, and no exposure of body and/or underwear should the top be displaced slightly.

Various alternatives have since been offered. Notably, in the design of bottom apparel are, but not confined to, the following:

1) The Obi Kutsurogi (designer Barbie White; trademark "O.K."). This consists of a wide elastic band that begins in back and curves lower in the front to come just below the tummy. It doesn't cover the tummy, but acts as a saddle on which the tummy rests and is thus supported. Since it doesn't cover the tummy, the hemline remains unchanged by growth, a particular advantage to skirts.

2) The Shirred Panel (designer Marilyn Stern, for Ninth Moon™). This garment is very similar in final effect to the O.K. ™-style, the main difference being it is a shirred panel which fully covers the tummy.

The above-described two developments in maternity wear have the same disadvantage: a panel which must be covered by a lengthy top. To avoid this disadvantage, the following have been devised:

3) The Harem Pant. These are cut and designed in such a manner that the expanding portion is actually in an elasticized back. This does not have the appearance of maternity wear, thus being a viable option of wearing apparel after pregnancy. A newer version of the harem pant has a soft elastic waistband that draws a large volume of fabric; thus the "one-size-fits-all" cliché applies, even to pregnant sizes.

4) Wrap pants. Most notably, designer Janit Baldwin has adapted a version from a traditional Japanese field pants wrap design, whereby each side of the pant is slitted, the back and front wrap as far as needed, and, at maximum expansion, the front and back don't overlap but tie at the side. This, as well as the harem pant, offers no abdominal or back support, and would not work well with skirts, as the hemline would constantly be changing.

5) The totally elasticized waistband. A good example of this style is the design of J. Edgar of California, who has created a skirt with drawcord elastic all the way around in the waistband. The front of the skirt is cut bigger and higher than on a normal skirt, creating a fairly unnoticeable pouch. By sewing in the seam at the "pouch" area in front, one can use the skirt after normal size is attained. Here again, the aforedescribed offers no particular support; additionally many would regard having to sew seams to remodel it to normal usage a nuisance.

6) "Sailor Pant" expandable waistband. This involves a buttoned and pleated waistband which is unbuttoned pleat by pleat as the waist expands and buttoned back closer as normal size is slowly attained after the pregnancy is over. The look in the front is that of an inverted pleat. Although a panel is not used, the appearance of this arrangement is that which one would normally prefer to have covered. Plus, it, too, has the disadvantage of no tummy support. Also, while practical enough for slacks, the skirt hemline is constantly in a state of change.

7) V-shaped elastic inserts. Such an insert is placed between the side seams of pants or skirts. This arrangement has the strong advantage of keeping the front as well as the back flat and even, and offering at least the same degree of support to the body as the normal garment. However, this kind of insert offers no means by which to use the same clothing after pregnancy.

None of the aforementioned maternity pant or skirt styles address the possibility of easily adapting pants or skirts one would have in their normal wardrobe for use during pregnancy and then easily converting these bottoms back to pre-pregnancy size. In addition to this, none feature a design in which the means by which the garment is converted to pregnancy wear is supportive of the expanded size as well as not permanently changing the normal entry opening in said garment. In addition, conventional maternity wear have the general appearance of pregnancy wear, that is, ballooned, blousy, or gathered.

Still, there is a need for an improvement in maternity wear that is simple in design and use. There is a need for a way to adapt normal pants or skirts to an expanded size during pregnancy, and to quickly and easily be re-convert them back to the smaller pre-pregnancy size. Additionally, there is a need for attractive, adapted clothing, preferably not having the appearance of conventional maternity wear, even though that is the purpose being served.

SUMMARY OF THE INVENTION

An object of the invention is to provide an attractive and easy way to adapt a woman's pair of jeans into maternity wear, extending the number of months she can wear her jeans as her shape changes and waistline expands. Another object is to provide an economical approach to maternity wear, which does not require sewing alternations or new clothing purchase. A further object is to provide maternity jeans or pants that still look attractive and tailored, so that a long, blousy top is not necessarily required to completely cover the top portion of the jeans or pants. Yet another object is to provide maternity wear that does not include bulky layers, pleats, or gatherings of material, but rather that is as sleek and neat-looking as the original jeans. A further object is to adapt every-day wear into maternity wear in such a manner that it may easily be converted back to its normal shape and size, without sewing, after the mother is back to her prematernity size. Further, another object is to provide maternity bottoms that offer at least the same firm support, unaltered hemlines, and easy-entry closures as anticipated in normal pants or skirts.

The invention comprises an insert with buttons arranged in a V-shape, adapted to button into the opening in a button-fly garment, such as a pair of Levi™ 501 blue jeans. The preferred insert is a generally V-shaped insert that includes a plurality of buttons on one side edge and a plurality of button-holes on the opposite side edge. The buttons and button-holes are aligned across from each other as if to cooperate, because the insert buttons fit into the button-holes of the fly of the jeans, and the insert button-holes receive the buttons of the fly of the jeans. Thus, the insert acts as a spacer to distance the cooperating portions of the fly and, thereby, to enlarge the waist.

The invented insert is preferably a firm, solid but slightly stretchable fabric panel, such as a firmly-woven polyester stretch fabric, that gives support to the wearer's tummy area and, in effect, also to the wearer's back, because the jeans act as a firm but gentle band around the woman's lower abdomen and lower back. The slightly-stretchy fabric also comfortably accommodates some growth and change during the weeks the woman wishes to wear one size of insert. Inserts may be supplied in an assortment of widths, so that the woman may switch to progressively-larger inserts during the months of her pregnancy, typically until a time when the particular woman becomes uncomfortable in any tailored or fitted garment. When expansion of the jeans if no longer needed, the insert can simply be removed and the garment fly buttoned as normal.

DESCRIPTION OF THE PREFERRED EMBODIMENTS

Referring to the Figures, there are shown several, but not the only, embodiments of the invented maternity insert for jeans. Whereas the preferred use of the insert is for button-fly jeans, such as Levi™ 501s, the insert may also be used and/or adapted for other front-button-fly garments.

Figure 1:
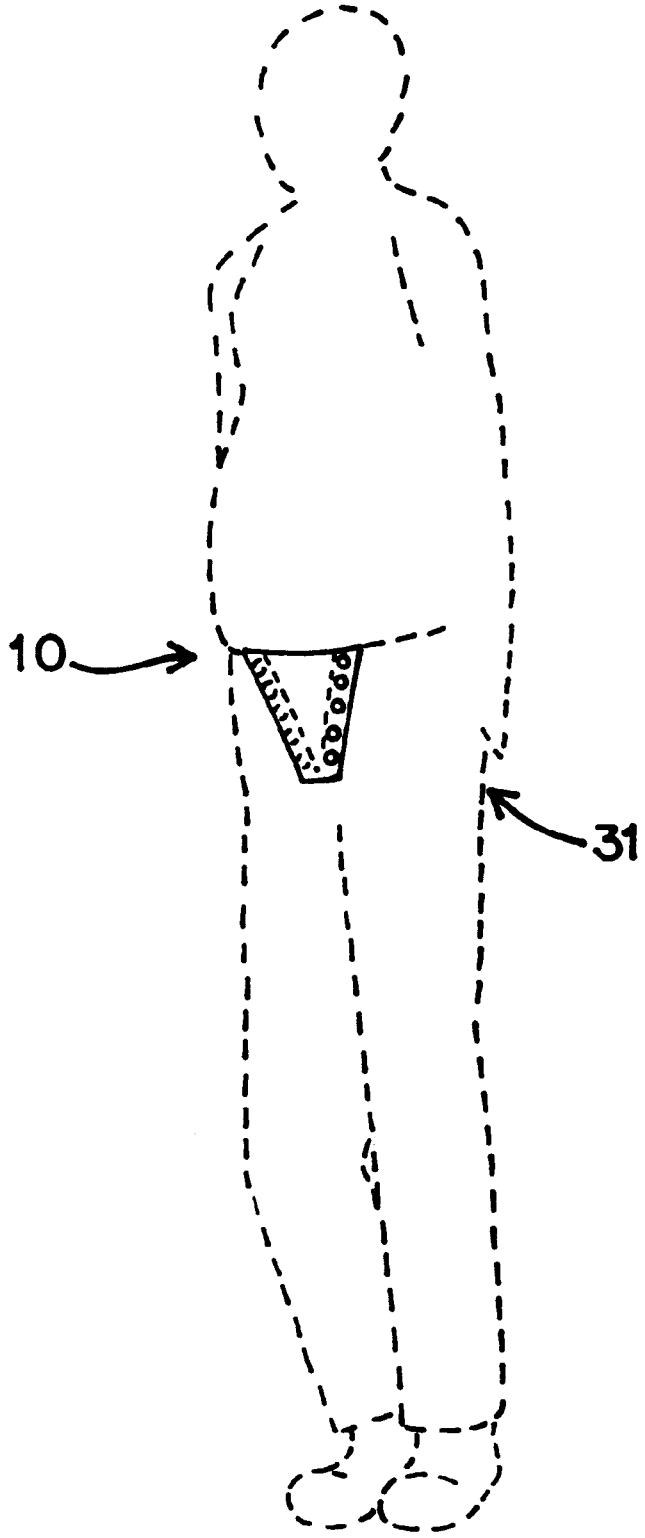
FIG. 1 is a front view of one embodiment of the invention, inserted into a pair of jeans shown in dashed lines.

As shown in FIG. 1, the insert 10 comprises a generally triangular or V-shaped panel 12 of fabric with a row of buttons 14 and a row of button-holes 16. The buttons 14 are in a generally straight line near a first side-edge 18 of the insert 10, and the button-holes 16 are in a generally straight line near a second side-edge 20 opposite the first side-edge 18. Thus, the buttons and holes come near to each other near the bottom of the panel 12, that is, at the squaredoff off bottom edge 62 or point of the "V". For most women's jeans, the buttons 14 are on the wearer's left side and the button-holes 16 are on the wearer's right side. The spacing between the buttons 14 is equal to the spacing between the holes 16, and buttons 14 are aligned horizontally with the holes 16, as if the buttons were designed to be buttoned into the holes 16. This arrangement allows the buttons 14 and holes 16 to cooperate with the jeans holes 24 and the jeans buttons 26, respectively, to distance the two sides of the fly 28 of the jeans 31 to enlarge the waist 33 of the jeans to make room for the mother-to-be's expanded waist.

Figure 2:
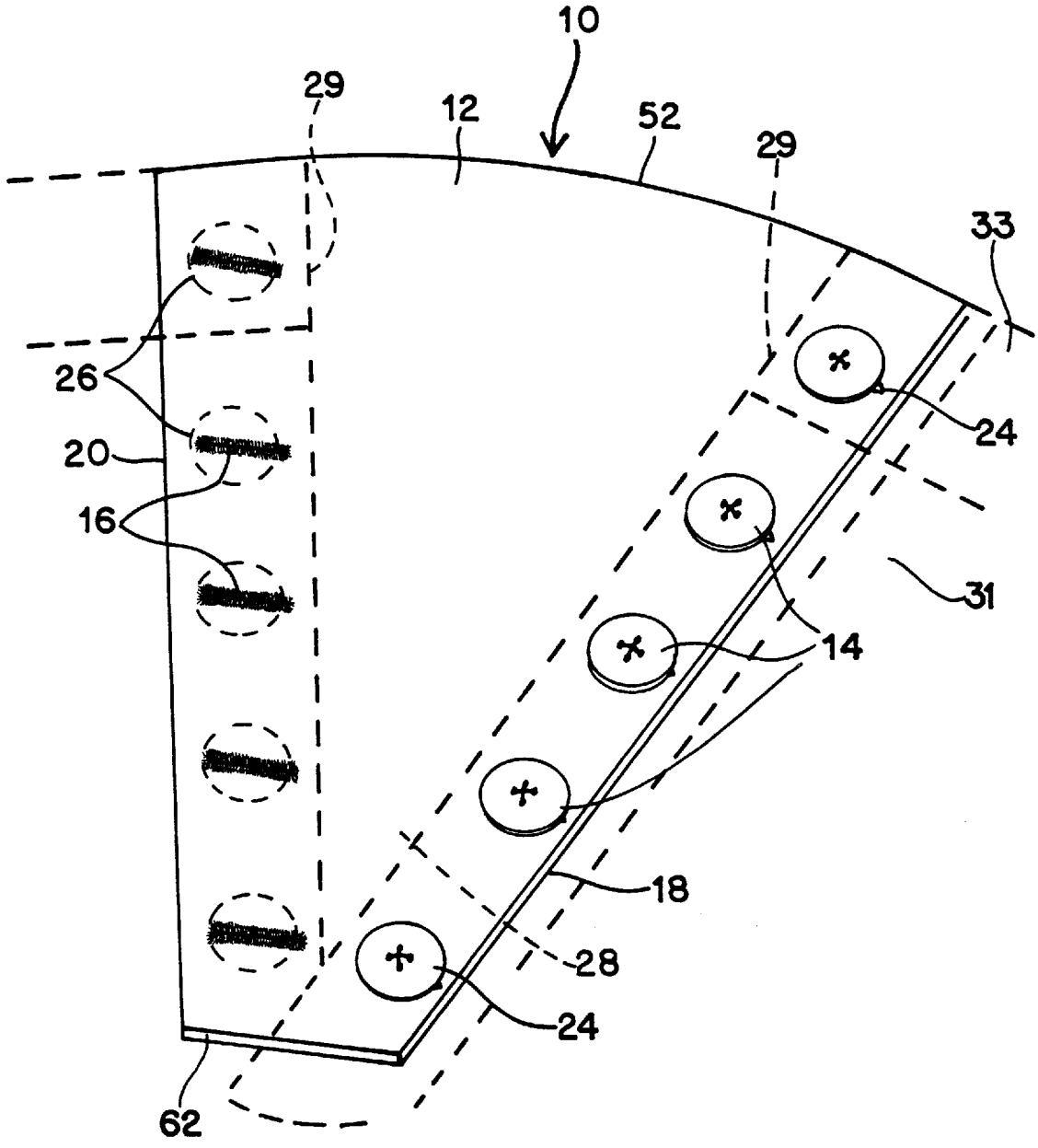
FIG. 2 is a front perspective view of the embodiment of FIG. 1 being worn by an expectant woman.

As shown by the environmental dashed lines in FIGS. 1 and 2, the insert lies at the front of the jeans, as an insert into the fly. The insert 10 is buttoned into the fly to be generally parallel and nearly coplanar to the fabric edges 29 of the fly. The insert 10 distances the two sides of the fly to greatly expand the waist size and upper area of the jeans, that is, most of the width of the jeans above the crotch.

Figure 3:
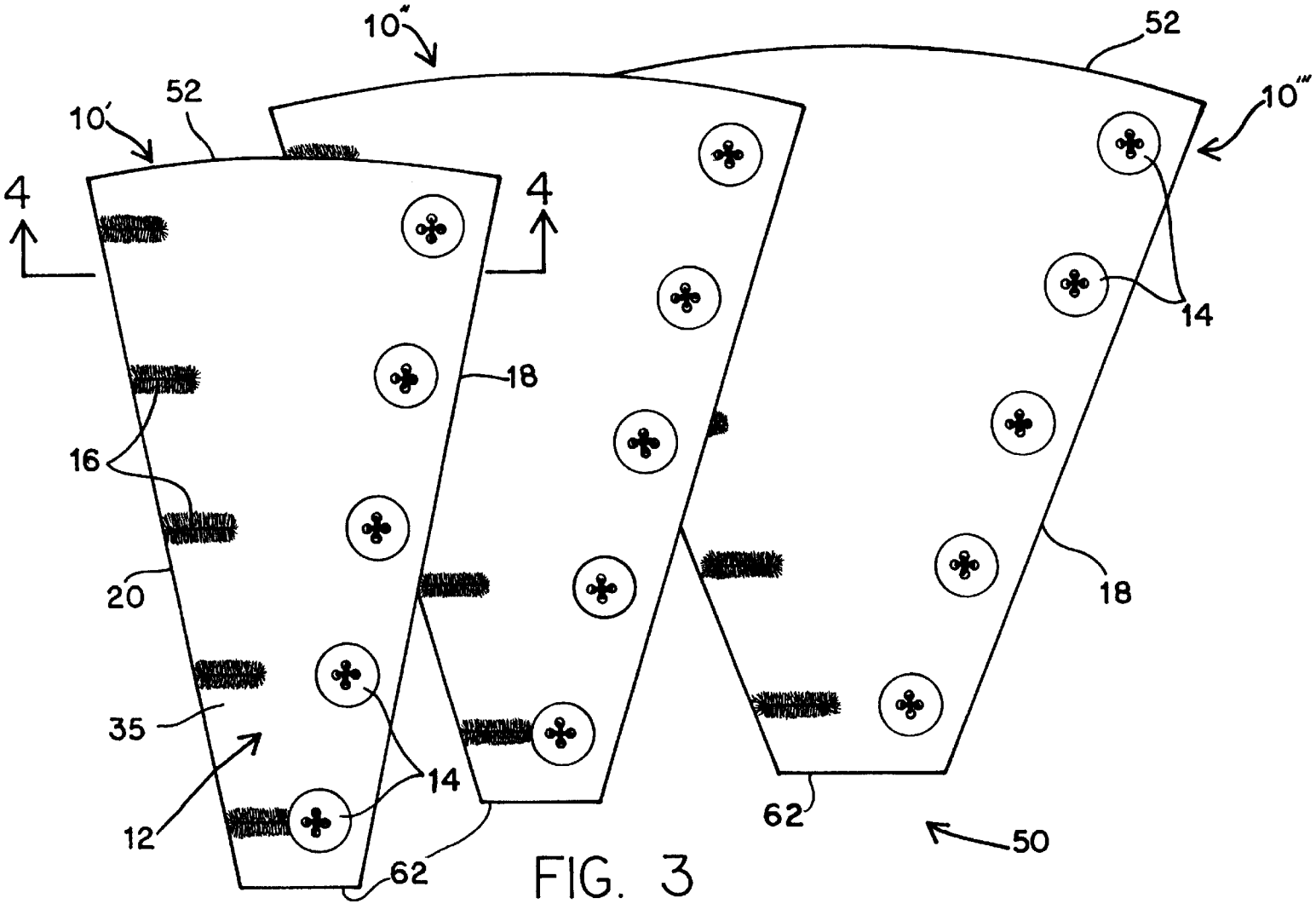
FIG. 3 is a front plan view of another embodiment of the invention, a set of inserts of differing sizes.
Figure 4:
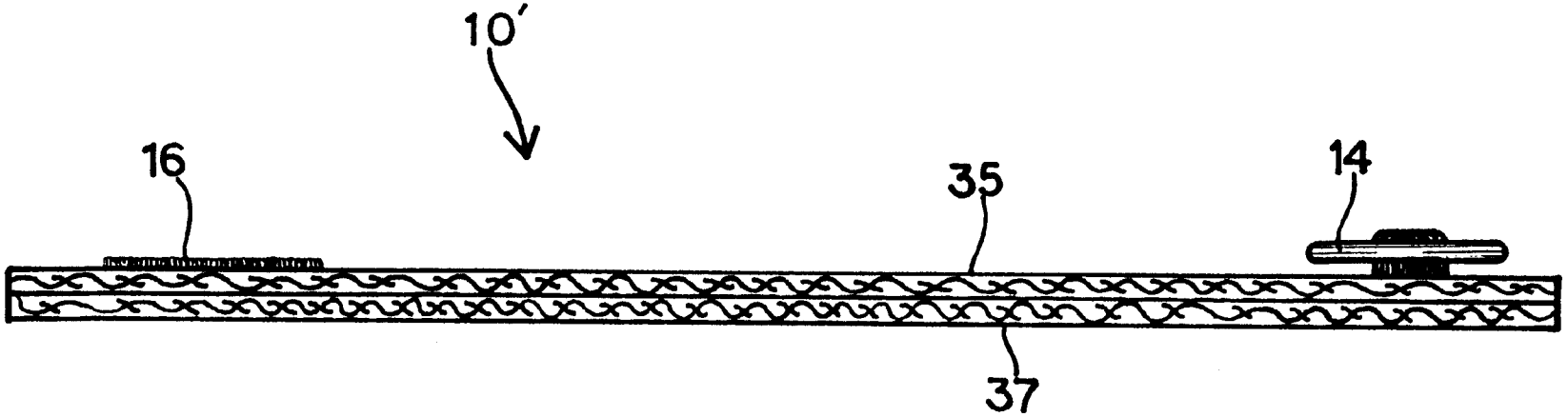
FIG. 4 is a cross-sectional view of one of the inserts of FIG. 3, viewed along the line 4—4 in FIG. 3.

As shown in FIG. 3, a plurality of inserts of different, incremental widths may be made and sold as a set, to allow the woman to adjust her jeans waist size as the weeks or months pass. The number of months that a woman will wish to wear her jeans expanded with the incrementally-sized inserts will depend on the particular woman's body style and the way her shape and size change as the months pass. For example, the first insert 10' of a set 50 of inserts may be only about 3 inches wide across its top edge 52 and long enough to fit appropriately into the fly, which is typically a length of about 7–8 inches. A second insert 10" may be about 5 inches across its top edge and the same length as the first insert 10'. A third insert 10'" may be about 7 inches wide at its top edge. Alternatively, other increments may be used, for example, increasing the insert widths by 1 inch at a time.

Inserts for popular button-fly jeans include five buttons and five button-holes. The preferred insert extends across and down the entire space created by distancing the fly edges, so that no gap between jeans and fabric is visible.

The insert is made of a flexible material, and, preferably, the insert 10 is made of a firm, but slightly stretchable material, such as is available as firmly-knit or woven polyester materials. The panel 12 may be a single layer of fabric. Alternatively, multiple layers may be used, preferably in a manner that avoids bulky construction. Two layers of fabric 35, 37 may be bonded (by fabric adhesive, for example) and/or sewn together to form a firm panel into which are placed the button-holes and the buttons. Standard sewing techniques may be used to add the button-holes and buttons. The layer or layers of the panel are preferably not doubled-over, pleated, or hemmed in any manner that would cause unevenness, ridges, folds or protrusions from the back side of the insert 10, so that the panel does not create discomfort or rubbing for the wearer.

The preferred insert is therefore thin and generally smooth, so that no significant bulk is added to the wearer's jeans and so that the wearer still has feels that her clothing and appearance is trim and neat. Preferably, the top edge 52 is curved upwards slightly to create a comfortable panel that does not "cut" into the wearer's skin even as it curves outward around the wearer's tummy.

Other shapes besides a V-shaped, or triangular, panel may be used, as long as the buttons and button-holes are arranged in rows that are typically at an acute angle, to place the rows in a V-relationship. However, the V-shaped panel is preferred, so that no large comers of material extend out past the bottom button and button-hole to possibly fold or bunch up.

The preferred insert 10 is a simple and economical item, consisting of a single V-shaped panel (single layered or multi-layered) with button-holes and buttons. The outer fabric may be colored to match or to contrast the garment, as desired. Thus, the insert panel may appear as a decorative addition to jeans or slacks, or may be colored to blend in to the jeans, without greatly or unattractively changing the general appearance of the front of the garment. In use, this insert does not hamper the normal opening/closure of the garment, because the wearer typically keeps the insert in place on the jean's buttons and simply un-buttons the insert buttons from the buttonholes of the jeans.

Although this invention has been described above with reference to particular means, materials and embodiments, it is to be understood that the invention is not limited to these disclosed particulars, but extends instead to all equivalents within the scope of the following claims.

I claim:

1. A set of a plurality of maternity inserts for a button-fly garment, each insert comprising:

a panel of flexible material, the panel having a first edge, a second edge, and a top edge curving upward between the first edge and the second edge;

a plurality of buttons attached to the panel in a generally straight row;

a plurality of button-holes in the panel in a generally straight row, so that the row of button-holes is at an acute angle to the row of buttons, so that there is a width of panel material between the top of the row of buttons and the top of the row of button-holes;

wherein the acute angle between buttons and button-holes is different for each of the plurality of inserts, so that the width of panel material between the top of the row of buttons and the top of the row of button-holes is different for each of the plurality of inserts; and wherein the top edge curves a different amount for each of the plurality of inserts, and the curve is greatest for the insert with the greatest width between the top of the row of buttons and the top of the row of button-holes.

2. A set as in claim 1, wherein the panel of flexible material of each insert is generally triangular, wherein the row of buttons is near the first edge and the row of button-holes is near the second edge, and wherein the panel of flexible material of each insert has a squared-off bottom edge opposite the top edge for extending through a button-fly garment fly.

* * * * *